US011624486B2

(12) United States Patent
Cho et al.

(10) Patent No.: US 11,624,486 B2
(45) Date of Patent: Apr. 11, 2023

(54) LIGHTING DEVICE

(71) Applicant: KH FEELUX CO., LTD., Gyeonggi-do (KR)

(72) Inventors: Beom Yeon Cho, Seoul (KR); Jun Jang, Seoul (KR)

(73) Assignee: KH FEELUX CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/786,694

(22) PCT Filed: Jun. 29, 2020

(86) PCT No.: PCT/KR2020/008444
§ 371 (c)(1),
(2) Date: Jun. 17, 2022

(87) PCT Pub. No.: WO2021/125473
PCT Pub. Date: Jun. 24, 2021

(65) Prior Publication Data

US 2023/0013292 A1 Jan. 19, 2023

(30) Foreign Application Priority Data

Dec. 19, 2019 (KR) ..... 10-2019-0171003
Jan. 23, 2020 (KR) ..... 10-2020-0009429

(51) Int. Cl.
*F21S 4/28* (2016.01)
*F21V 3/00* (2015.01)

(52) U.S. Cl.
CPC . *F21S 4/28* (2016.01); *F21V 3/00* (2013.01)

(58) Field of Classification Search
CPC ..... F21S 4/28; F21V 3/00
See application file for complete search history.

(56) References Cited

U.S. PATENT DOCUMENTS 6,169,373 B1 * 1/2001 Riesinger ..... F21L 14/023 315/307
9,091,401 B2 * 7/2015 Wong ..... F21V 14/025
2005/0180162 A1 8/2005 Fan
2008/0239730 A1 * 10/2008 Chien ..... F21L 14/02 362/368

(Continued)

FOREIGN PATENT DOCUMENTS

JP 2013-077400 A 4/2013
KR 10-2012-0040635 A 4/2012

(Continued)

OTHER PUBLICATIONS

International Search Report for PCT/KR2020/008444 dated Oct. 6, 2020.

(Continued)

*Primary Examiner* — Mary Ellen Bowman
(74) *Attorney, Agent, or Firm* — The PL Law Group, PLLC

(57) ABSTRACT

A lighting device according to an embodiment of the present disclosure includes a lighting part which includes a substrate provided along a longitudinal direction of the lighting device and a lighting unit provided on the substrate, and a diffusing part which is provided along the longitudinal direction of the lighting device, accommodates the lighting part therein, and diffuses light generated in the lighting part.

18 Claims, 14 Drawing Sheets

(56) References Cited

U.S. PATENT DOCUMENTS

| | | | | |
|---|---|---|---|---|
| 2010/0039801 | A1* | 2/2010 | Pelletier | F21L 2/00 362/184 |
| 2011/0157882 | A1* | 6/2011 | Wessel | F21L 4/027 362/205 |
| 2012/0176767 | A1* | 7/2012 | Whitfield | F21L 14/023 362/33 |
| 2013/0094196 | A1* | 4/2013 | Wessel | F16M 11/10 362/198 |
| 2014/0140050 | A1* | 5/2014 | Wong | F21V 14/025 362/217.1 |
| 2016/0356439 | A1* | 12/2016 | Inskeep | F21V 21/30 |
| 2019/0195445 | A1* | 6/2019 | Chien | H01R 33/92 |
| 2021/0033248 | A1* | 2/2021 | Cacciabeve | F21V 21/30 |

FOREIGN PATENT DOCUMENTS

| | | | |
|---|---|---|---|
| KR | 10-1300147 | B1 | 8/2013 |
| KR | 10-2013-0140989 | A | 12/2013 |
| KR | 10-2016-0112912 | A | 9/2016 |
| KR | 10-2018-0110911 | A | 10/2018 |

OTHER PUBLICATIONS

Office action dated Nov. 30, 2021 from Korean Patent Office in a counterpart Korean Patent Application No. 10-2020-0009429 (English translation is also submitted herewith.).

* cited by examiner

LIGHTING DEVICE

CROSS REFERENCE TO RELATED APPLICATIONS AND CLAIM OF PRIORITY

This application claims benefit under 35 U.S.C. 119, 120, 121, or 365(c), and is a National Stage entry from International Application No. PCT/KR2020/008444, filed Jun. 29, 2020, which claims priority to the benefit of Korean Patent Application No. 10-2019-0171003 filed in the Korean Intellectual Property Office on Dec. 19, 2019 and Korean Patent Application No. 10-2020-0009429 filed in the Korean Intellectual Property Office on Jan. 23, 2020, the entire contents of which are incorporated herein by reference.

BACKGROUND

1. Technical Field

Embodiments of the present invention relate to a lighting device.

2. Background Art

Light emitting diodes (LEDs) have advantages of being small and having a long lifespan when compared to a light source according to the related art, such as incandescent lamps and fluorescent lamps. In addition, the light emitting diodes have excellent energy efficiency because electric energy is directly converted into light energy and thus have an advantage of low power consumption. Due to these characteristics, the light emitting diodes are not only used as light sources for various display devices, but are also in spotlight as lighting devices such as indoor/outdoor lightings, signboard lightings, and general residential lightings.

When the light emitting diodes are used as the lighting devices, a plurality of light emitting diodes may be mounted on, for example, a PCB substrate and thus be implemented as a bar-type LED module. The bar-type LED module is mainly used in connection with an adjacent bar-type LED module.

SUMMARY

An embodiments of the present invention is to provide a lighting device that is capable of being firmly coupled to an adjacent lighting device and being improved in easy of assembly.

An embodiment of the present invention is to provide a lighting device capable of preventing a lighting part from being damaged by an external impact and preventing an electric shock accident from occurring.

The disclosed lighting device according to an embodiment includes: a lighting part including a substrate provided along a longitudinal direction of the lighting device and a lighting unit provided on the substrate; and a diffusing part provided along the longitudinal direction of the lighting device, and configured to accommodate the lighting part therein, and configured to diffuse light generated in the lighting part.

The diffusing part may include a first diffusing body configured to accommodate the lighting part therein, wherein the first diffusing body may include: a first side plate provided on each of both side surfaces of the first diffusion body; and a substrate accommodation part protruding from an inner surface of the first side plate to the inside of the diffusing part to form a space in which the lighting part is accommodated.

The substrate accommodation part may include: a first substrate accommodation part protruding from a lower end of the inner surface of the first side plate to the inside of the diffusing part; and a second substrate accommodation part protruding from an upper end of the inner surface of the first side plate to the inside of the diffusing part, wherein the lighting part may be slid and accommodated into a space between the first substrate accommodation part and the second substrate accommodation part.

The substrate may have a width greater than each of an interval between the first substrate accommodation parts and an interval between the second substrate accommodation parts.

The diffusing part may further include: a second diffusing body provided above the first diffusing body; and a third diffusing body provided below the first diffusing body.

The second diffusing body may have both ends, which further protrude in a longitudinal direction of the diffusing part than both ends of the first diffusing body, respectively, and the third diffusing body may be provided to have a length corresponding to a length of the first diffusing body.

The second diffusing body may include: a second side plate connected to the first diffusion body at an upper end of the first diffusing body and provided on each of both side surfaces of the second diffusing body; and a second connection plate provided to connect the second side plate at an upper end of the second side plate.

The third diffusing body may include: a third side plate connected to the first diffusing body at a lower end of the first diffusing body and provided on each of both side surfaces of the third diffusing body; and a second connection plate provided to connect the third side plates to each other between the third side plates, wherein the third side plate may include a first seating groove provided along a longitudinal direction of the third side plate on an outer surface of the third side plate.

The lighting device may further include a housing part coupled to the outside of the third diffusing body, wherein the housing part may include: a first housing part provided on an outer surface of the third side plate and including a first hook protrusion seated in the first seating groove at an upper end of the first housing part so as to be coupled to the third diffusing body; and a second housing part provided to connect a lower end of the first housing part.

The third side plate may further include a bent part bent from a lower end of the third side plate to the inside of the diffusing part, wherein the second housing part may include: a second-1 housing part connected inward from each of lower ends of both sides of the first housing part; a second-2 housing part protruding upward from a top surface of the second-1 housing part; and a second-3 housing part provided to connect upper ends of the second-2 housing parts to each other, wherein the bent part may be inserted between the first housing part and the second-2 housing part and seated on a top surface of the second-1 housing part.

The lighting device may further include a housing part coupled to the outside of the diffusing part.

The diffusing part may include: a first diffusing body configured to accommodate the lighting part therein; a second diffusing body provided above the first diffusing body; and a third diffusing body provided below the first diffusing body.

The third diffusing body may have a width less than a width of the first diffusing body.

The lighting device may further include a connection device mechanically and electrically coupled to an end of the lighting device, wherein the connection device may include: a connection body part including a connection body side part protruding upward from each of both sides of a top surface thereof; a first coupling protrusion provided to protrude from a front end of the connection body side part to the diffusing part and inserted into the third diffusing body so as to be coupled to the third diffusing body; and a substrate seating part which is provided on an upper portion of the connection body part an on which the substrate is seated.

The third diffusing body may include a hook hole provided in a side surface of the third diffusing body, and the first coupling protrusion may include a second hook protrusion inserted into and hooked with the hook hole at an end thereof.

The connection device may further include: a side frame provided to be spaced apart from the connection body part on both side surfaces of the connection body part; and a side frame connection part configured to connect to the connection body side part to the side frame, wherein the side frame may include a pressing part provided to protrude on an outer surface of a front end thereof.

The second diffusing body may include a slide coupling protrusion of which both ends are provided to further protrude in a longitudinal direction of the diffusing part than both ends of the first diffusing body and which is provided along a longitudinal direction of the second diffusing body at a lower end of the protruding second diffusing body, and the connection device may further include a slide coupling part provided to protrude upward from both sides of the substrate seating part and provided with a slide coupling groove so that the slide coupling protrusion is slidably inserted into an upper end thereof.

The lighting device may further include a housing part coupled to the outside of the third diffusing body, and the connection part may further include a second coupling protrusion provided to protrude from a front surface of the connection body part to the diffusing part and inserted into a space formed in a lower portion of the housing part so as to be coupled to the housing part.

The connection part may further include: a third coupling protrusion provided to protrude from a front surface of the slide coupling part to the diffusion part and inserted into the first diffusing body so as to be coupled to the first diffusing body; and a finishing frame which is provided to protrude upward from a rear end of the substrate seating part and of which an upper end is inserted into and coupled to the second diffusing body.

The connection device may further include: a first connection coupling part provided to protrude outward from a rear end of the connection body part, coupled to a connection device of another lighting device adjacent to the lighting device, and including a connection terminal insertion hole into which the connection terminal part is inserted; and a second connection coupling part provided to protrude outward from the rear end of the connection body part and coupled to the connection device of another lighting device.

According to the embodiment of the present invention, since the substrate of the lighting part is accommodated in the substrate accommodation part within the diffusing part, the lighting part may be prevented from being damaged by the external impact, and the diffusing part made of the insulating material may be provided in the form that surrounds the lighting part to prevent the electric shock accident from occurring.

In addition, since the connection device is coupled four times to one end of the lighting part, the firm coupling may be possible. That is, since the first coupling protrusion is primarily coupled while being inserted into the third diffusing body, the second coupling protrusion is secondarily coupled while being inserted into the lower end of the housing part, the slide coupling part is thirdly coupled while being slidably coupled to the second diffusing body, and the third coupling protrusion is fourthly coupled while being inserted into the first diffusing body, the connection device and the lighting device may be firmly coupled to each other to prevent the connection device from being twisted or bent. Therefore, the lighting devices may also be firmly coupled to each other through the connection device.

DETAILED DESCRIPTION

Hereinafter, embodiments of the present invention will be described in detail with reference to the accompanying drawings. The following detailed descriptions are provided to help comprehensive understanding of a method, an apparatus, and/or a system described in this specification. However, this is merely an example, and the present invention is not limited thereto.

In descriptions of embodiments of the present invention, detailed descriptions related to the well-known technologies will be ruled out in order not to unnecessarily obscure subject matters of the present invention. Also, terms used in the present specification are terms defined in consideration of functions according to embodiments, and thus the terms may be changed according to the intension or usage of a user or operator. Therefore, the terms should be defined on the basis of the overall contents of this specification. The terms used in the present specification are merely used to describe particular embodiments, and are not intended to limit the present invention. An expression used in the singular encompasses the expression in the plural, unless it has a clearly different meaning in the context. In the present specification, it is to be understood that terms such as "including" or "having", etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Directional terms such as upper side, lower side, one side, the other side, etc. are used in connection with the orientation of the disclosed drawings. Since components according to embodiments of the present invention may be set to be disposed in various orientations, the directional terminology is used for purposes of illustration and not limitation.

In addition, terms such as first and second may be used to describe various components, but the components should not be limited by the terms. The terms may be used only for the purpose of distinguishing one component from another. For example, a first component in one embodiment can be referred to as a second element in another embodiment without departing from the scope of the appended claims.

Figure 1:
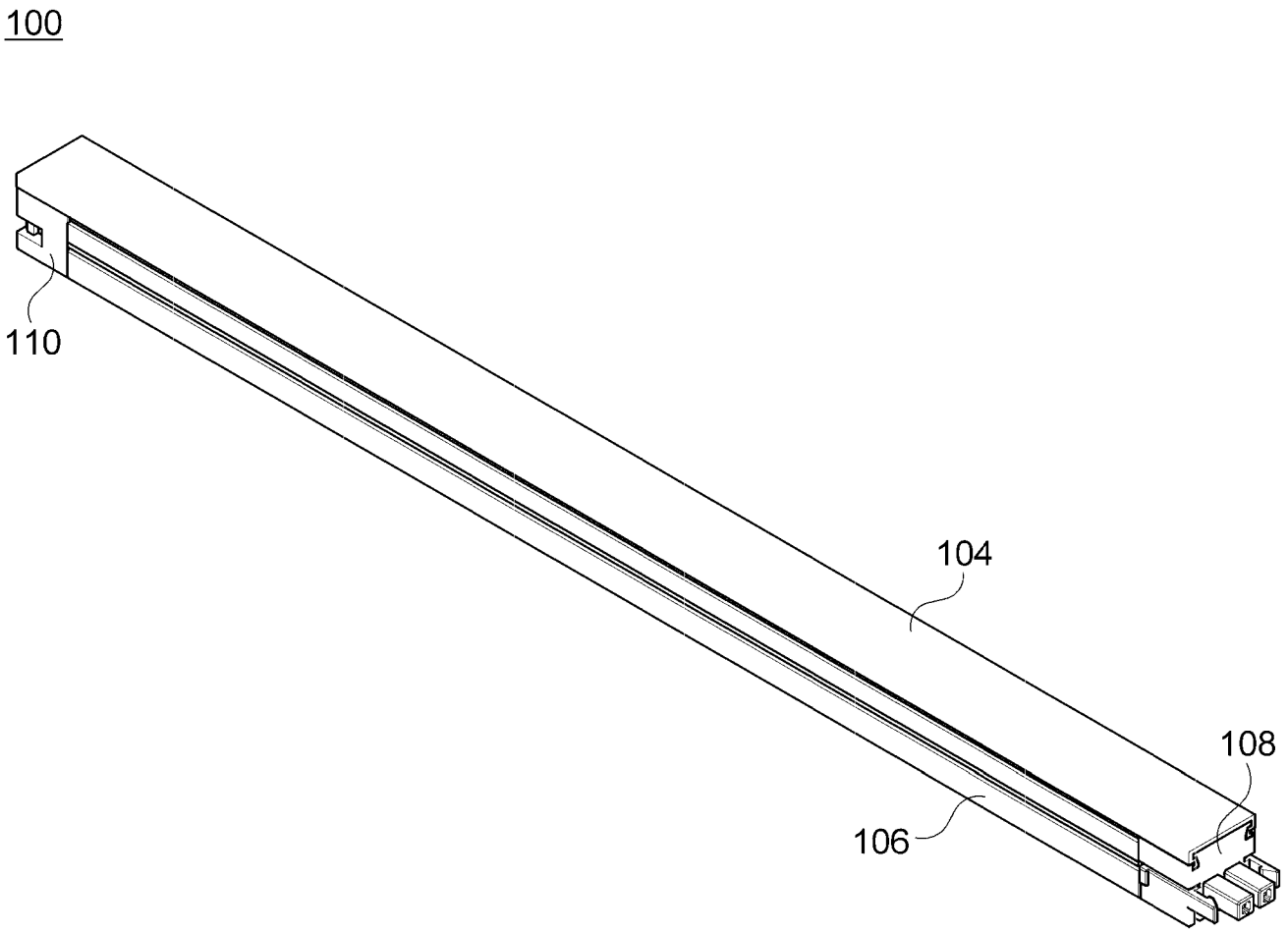
FIG. 1 is a perspective view illustrating a lighting device according to an embodiment of the present invention.
Figure 2:
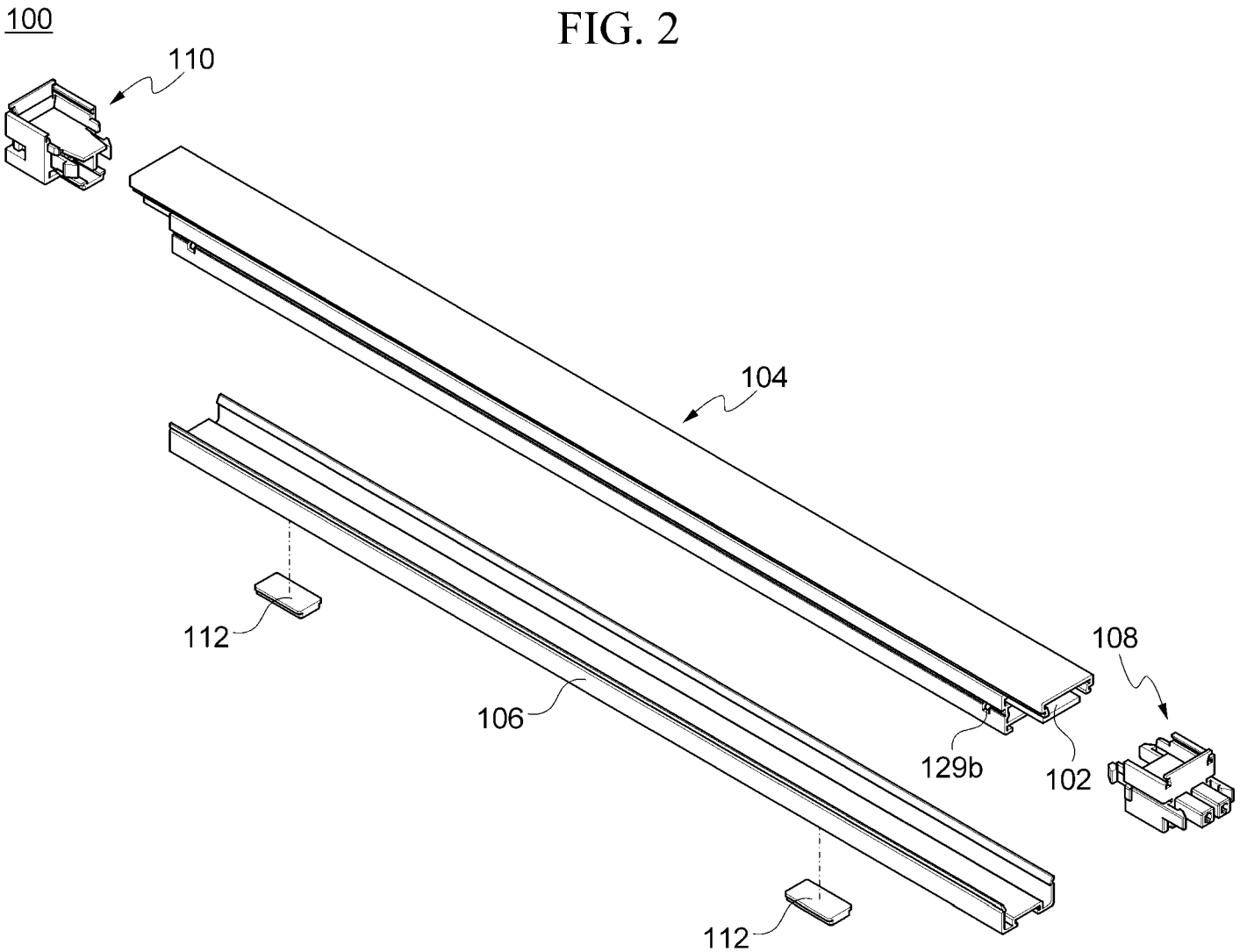
FIG. 2 is an exploded perspective view illustrating the lighting device according to an embodiment of the present invention.
Figure 3:
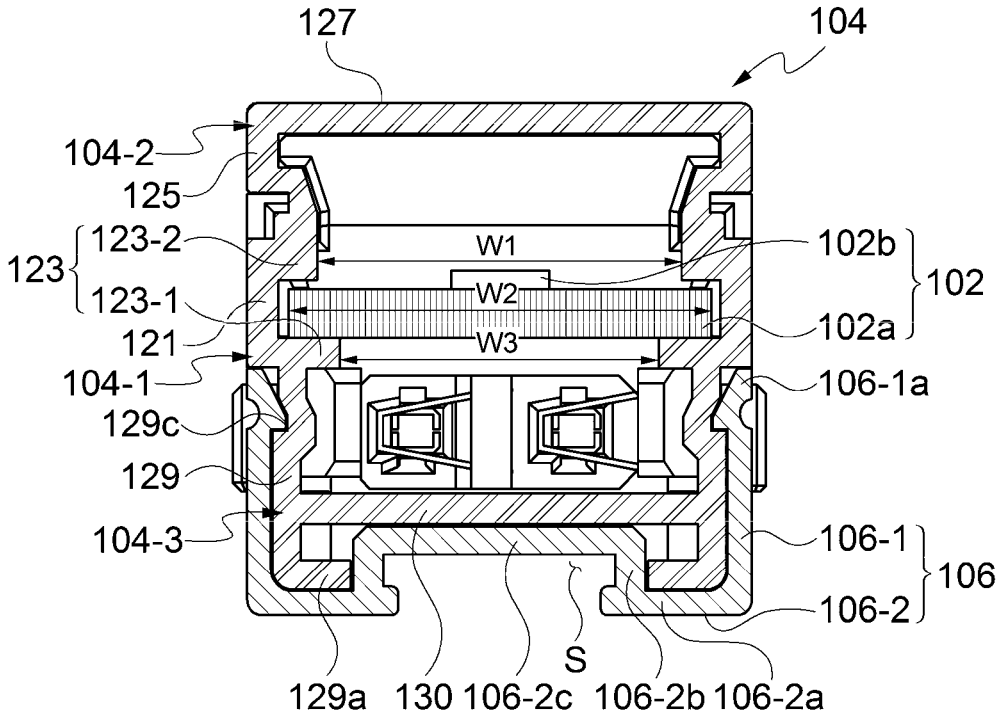
FIG. 3 is a cross-sectional view illustrating the lighting device according to an embodiment of the present invention.

FIG. 1 is a perspective view illustrating a lighting device according to an embodiment of the present invention, FIG. 2 is an exploded perspective view illustrating the lighting device according to an embodiment of the present invention, and FIG. 3 is a cross-sectional view illustrating the lighting device according to an embodiment of the present invention.

Referring to FIGS. 1 to 3, a lighting device 100 may include a lighting part 102, a diffusing part 104, a housing part 106, a first connection device 108, and a second connection device 110. In an exemplary embodiment, the lighting device 100 may be provided in a bar-type having a predetermined length.

The lighting part 102 may be accommodated in the diffusing part 104. The lighting part 102 may include a substrate 102*a* and a lighting unit 102*b*. The substrate 102*a* may be provided along a longitudinal direction of the lighting device 100. The substrate 102*a* may be seated and accommodated in the diffusing part 104.

One or more lighting unit 102*b* may be provided on one surface of the substrate 102*a*. A light emitting diode (LED) or the like may be used as the lighting unit 102*b*. In an exemplary embodiment, the plurality of lighting unit 102*b* may be arranged to be spaced apart from each other along a longitudinal direction of the substrate 102*a*. Here, a line pattern (not shown) electrically connected to the lighting unit 102*b* may be provided on the other surface of the substrate 102*a*.

The diffusing part 104 may serve to diffuse light generated by the lighting part 102. The diffusing part 104 may be provided along the longitudinal direction of the lighting device 100. The diffusing part 104 may be made of an insulating material. The diffusing part 104 may include a first diffusing body 104-1, a second diffusing body 104-2, and a third diffusing body 104-3. The first diffusing body 104-1, the second diffusing body 104-2, and the third diffusing body 104-3 may be provided to be integrated with each other.

The first diffusing body 104-1 may be provided at a center of the diffusing part 104. The first diffusing body 104-1 may include a first side plate 121 and a substrate accommodation part 123. The first side plate 121 may constitute both side surfaces of the first diffusing body 104-1. The substrate accommodation part 123 may protrude from an inner surface of the first side plate 121 to the inside of the diffusing part 104 to form a space in which the lighting part 102 is accommodated. The substrate accommodation part 123 may include a first substrate accommodation part 123-1 and a second substrate accommodation part 123-2.

The first substrate accommodation part 123-1 may be provided to protrude from a lower end of the inner surface of the first side plate 121 to the inside of the diffusing part 104 by a first length. The second substrate accommodation part 123-2 may be provided to protrude from an upper end of the inner surface of the first side plate 121 to the inside of the diffusing part 104 by a second length. Here, the second length may be less than the first length, but is not limited thereto and may be the same as the first length or greater than the first length. Each of the first substrate accommodation part 123-1 and the second substrate accommodation part 123-1 may be provided along the longitudinal direction of the diffusing part 104.

Here, the substrate 102*a* may be accommodated between the first substrate accommodation part 123-1 and the second substrate accommodation part 123-2. That is, the substrate 102*a* may be slid and accommodated into a space between the first substrate accommodation part 123-1 and the second substrate accommodation part 123-2. A bottom surface of the substrate 102*a* may be seated in the first substrate accommodation part 123-1. An interval W1 between the second substrate accommodation parts 123-2 may be less than a width W2 of the substrate 102*a*. That is, the width W2 of the substrate 102*a* may be provided to be greater than the interval W1 between the second substrate accommodation parts 123-2. Thus, it is possible to prevent the substrate 102*a* from being separated upward. In addition, the width W2 of the substrate 102*a* may be provided to be greater than an interval W3 between the first substrate accommodation parts 123-1.

Here, although the interval W3 between the first substrate accommodation parts 123-1 is less than the interval W1 between the second substrate accommodation parts 123-2, the present invention is not limited thereto. For example, the interval W3 between the first substrate accommodation parts 123-1 may be the same as the interval W1 between the second substrate accommodation parts 123-2. In addition, the interval W3 between the first substrate accommodation parts 123-1 may be greater than the interval W1 between the second substrate accommodation parts 123-2.

In the disclosed embodiment, since the substrate 102*a* of the lighting part 102 is accommodated in the substrate accommodation part 123 within the diffusing part 104, it is possible to prevent the lighting part 102 from being damaged by an external impact, and the lighting part 104 made of the insulating material may surround the lighting part 102 to prevent an electric shock accident from occurring.

The second diffusing body 104-2 may be provided above the first diffusing body 104-1. The second diffusing body 104-2 may be provided longer than the first diffusing body 104-1. In an exemplary embodiment, both ends of the second diffusing body 104-2 may be provided to further protrude in the longitudinal direction of the diffusing part 104 than both ends of the first diffusing body 104-1.

As described above, both the ends of the second diffusing body 104-2 may be provided to further protrude in the longitudinal direction of the diffusing part 104 than both the ends of the first diffusing body 104-1 to prevent the substrate 102*a* from being exposed to the outside even though both the ends of the substrate 102*a* protrude from both the ends of the first diffusing body 104-1 in the longitudinal direction so as to be seated on the first connection device 108. In addition, it is possible to prevent a dark zone from being generated when the lighting device 100 is coupled to another lighting device.

The second diffusing body 104-2 may include a second side plate 125 and a first connection plate 127. The second side plate 125 may be provided in connection with the first diffusing body 104-1 at an upper end of the first diffusing body 104-1. The second side plate 125 may be provided to further extend from an upper end of the first diffusing body 104-1 than a length of the first diffusing body 104-1. The first connection plate 127 may be provided by connecting the second side plate 125 at the upper end of the second side plate 125.

The third diffusing body 104-3 may be provided below the first diffusing body 104-1. The third diffusing body 104-3 may be provided to have a length corresponding to that of the first diffusing body 104-1. The third diffusing body 104-3 may include a third side plate 129 and a second connection plate 130.

The third side plate 129 may be provided in connection with the first diffusing body 104-1 at a lower end of the first diffusing body 104-1. A bent part 129*a* bent to the inside of the diffusing part 104 may be provided at a lower end of the third side plate 129. A hook hole 129*b* may be provided at each of both ends of the third side plate 129. The second connection plate 130 may be provided by connecting the third side plate 129 at the lower end of the third side plate 129.

The third diffusing body 104-3 may be provided to have a width narrower than the width of the first diffusing body 104-1. That is, since the third diffusing body 104-3 is disposed below the lighting part 102 and is not a portion at which light generated from the lighting part 102 is diffused, but is a portion at which the housing part 106 is coupled to the outside of the third diffusing body 104-3, the third diffusing body 104-3 may be provided to have a width narrower than that of the first diffusing body 104-1.

In addition, the second diffusing body 104-2 may be provided to have a width greater than that of the third diffusing body 104-3. In an exemplary embodiment, the second diffusing body 104-2 may be provided to have the same width as the first diffusing body 104-1. Since the second diffusing body 104-2 is disposed above the lighting part 102, the light generated from the lighting part 102 is diffused, and thus, the second diffusing body 104-2 may be provided to have a width greater than that of the third diffusing body 104-3. In addition, the second diffusing body 104-2 may include a section in which the width gradually increases from the lower end to the upper end. Thus, it is possible to more efficiently diffuse the light generated by the lighting part 102.

In the exemplary embodiment, the second diffusing body 104-2 may be provided to have the same as the width of the first diffusing body 104-1, and the third diffusing body 104-3 may be provided to have a width less than that of the first diffusing body 104-1. As the housing part 106 is coupled to the outside of the third diffusing body 104-3, the lighting device 100 may be maintained in the same width in the entire section from the first diffusing body 104-1 to the second diffusing body 104-3. However, the present invention is not limited thereto.

The housing part 106 may be provided below the diffusing part 104. The housing part 106 may be provided along the longitudinal direction of the diffusing part 104. In an exemplary embodiment, the housing part 106 may be coupled to the third diffusing body 104-3. The housing part 106 may be coupled to the third diffusing body 104-3 to surround the third diffusing body 104-3 from the outside. In an exemplary embodiment, the housing part 106 may be made of a metal material, but is not limited thereto.

The housing part 106 may include a first housing part 106-1 and a second housing part 106-2. The first housing part 106-1 may be provided on an outer surface of each of both sides (i.e., the third side plate 129) of the third diffusing body 104-3. A first hook protrusion 106-1*a* to be coupled to the third diffusing body 104-3 may be provided on an upper end of the first housing part 106-1.

The first hook protrusion 106-1*a* may be provided along the longitudinal direction of the first housing part 106-1. The first hook protrusion 106-1*a* may be provided to be inclined inward from the upper end of the first housing part 106-1. In addition, a first seating groove 129*c* in which the first hook protrusion 106-1*a* is seated may be provided in an outer surface of the third side plate 129.

The second housing part 106-2 may be provided by connecting a lower end of the first housing part 106-1. The second housing part 106-2 may include a second-1 housing part 106-2*a*, a second-2 housing part 106-2*b*, and a second-3 housing part 106-2*c*. The second-1 housing part 106-2*a* may be connected to the inside from the lower end of the first housing part 106-1. The second-2 housing part 106-2*b* may protrude upward from a top surface of the second-1 housing part 106-2*a*.

The second-3 housing part 106-2*c* may be provided by connecting an upper end of the second-2 housing part 106-2*b*. Thus, a predetermined space S is formed in a lower portion of the second-3 housing part 106-2*c*. Here, an end of the second-1 housing part 106-2*a* may be provided to protrude toward the space S.

Here, the top surface of the second-3 housing part 106-2*c* may be in contact with a bottom surface of the second connection plate 130. Also, the bent part 129*a* may be seated on a top surface of the second-1 housing part 106-2*a*. The bent part 129*a* may be inserted between the first housing part 106-1 and the second-2 housing part 106-2*b* so as to be seated on the top surface of the second-1 housing part 106-2*a*. Therefore, the coupling between the third diffusing body 104-3 and the housing part 106 may be strengthened.

In addition, as the housing part 106 is provided to surround the third diffusing body 104-3 that does not diffuse light, it is possible to reinforce external rigidity of the third diffusing body 104-3. Here, the diffusing part 104 may be made of an insulating material, and the housing part 106 may be made of a material different from that of the diffusing part 104, i.e., a material (for example, a metal material, etc.) that is superior in rigidity than the diffusing part 104 to improve durability and provide an elegant appearance while reinforcing external rigidity of the third diffusing body 104-3.

One or more magnetic members 112 may be provided in the space S formed under the second-3 housing part 106-2*c*. The magnetic member 112 may serve to attach the lighting device 100 to a mounting surface (e.g., a metal mounting surface) on which the lighting device 100 is to be mounted.

The first connection device 108 may be mechanically and electrically coupled to the lighting device 100 at one end of the lighting device 100. In addition, the second connection device 110 may be mechanically and electrically coupled to the lighting device 100 at the other end of the lighting device 100. The first connection device 108 and the second connection device 110 may serve to mechanically and electrically couple the lighting device 100 to another lighting device.

Figure 4:
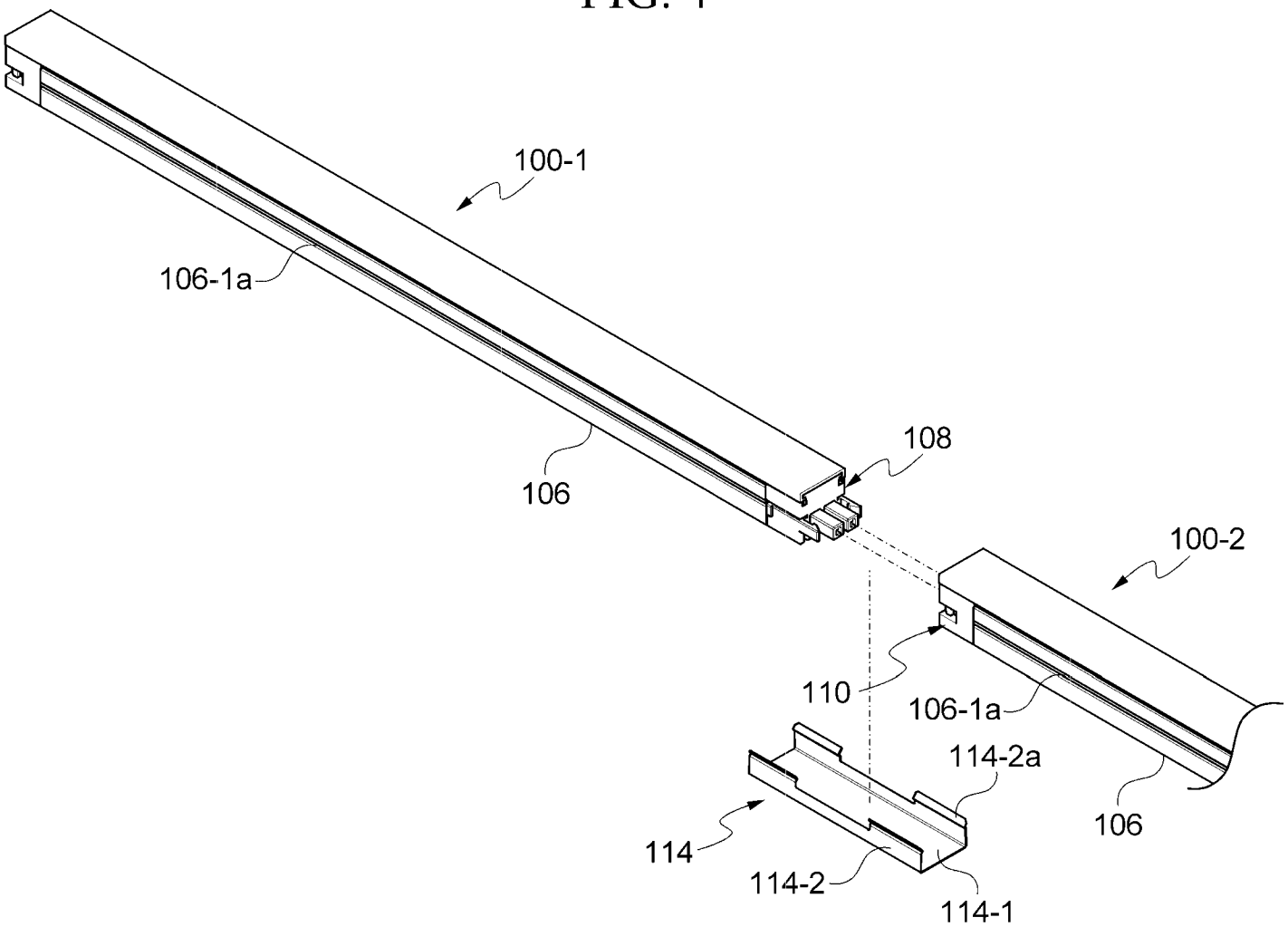
FIGS. 4 and 5 are views illustrating a state in which lighting devices are coupled to each other according to an embodiment of the present invention.
Figure 5:
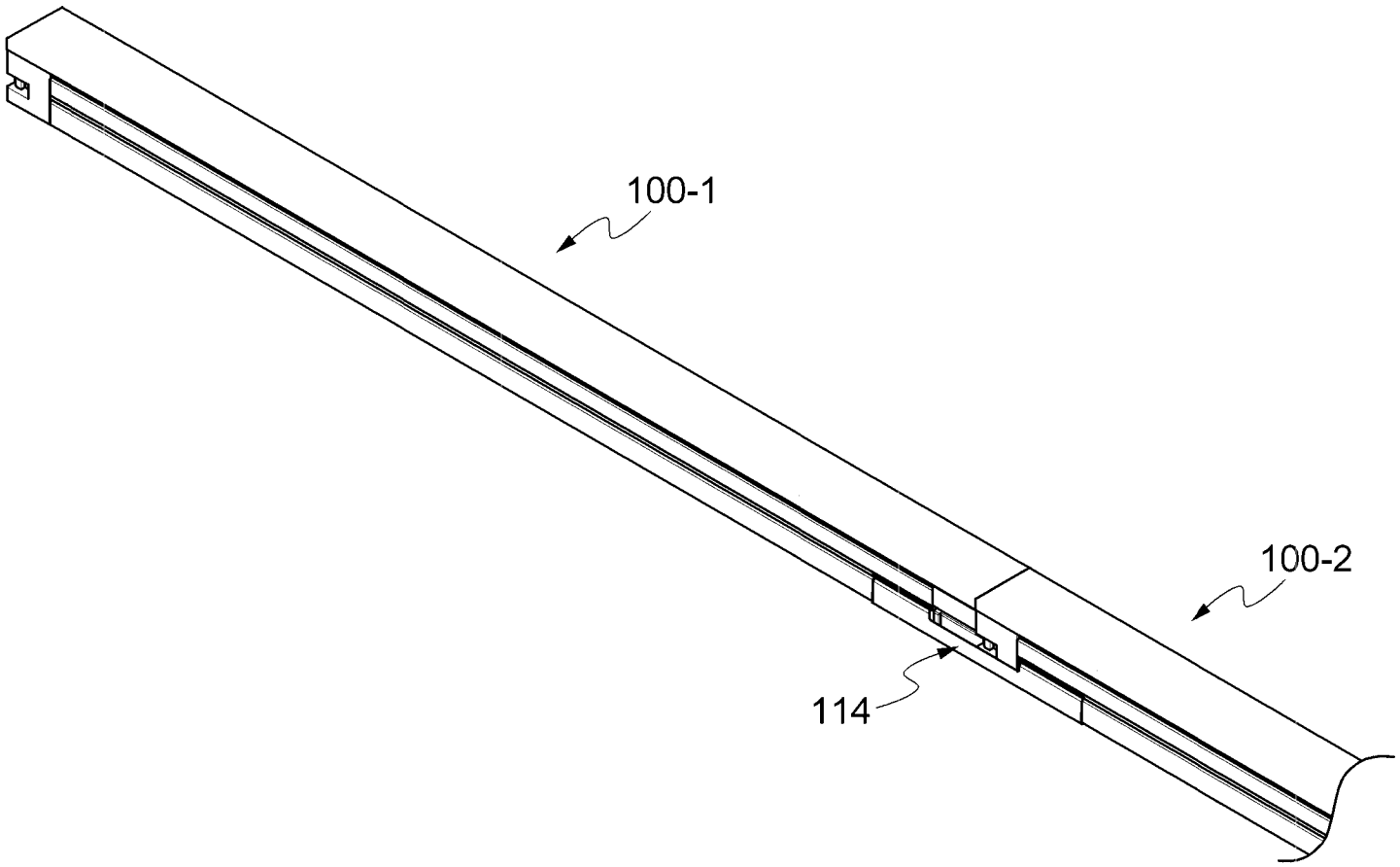

FIGS. 4 and 5 are views illustrating a state in which lighting devices are coupled to each other according to an embodiment of the present invention.

Referring to FIGS. 4 and 5, a first lighting device 100-1 and a second lighting device 100-2 may be arranged in a line. The first lighting device 100-1 and the second lighting device 100-2 may be coupled to each other in a straight coupling method. Specifically, one end of the first lighting device 100-1 may be disposed to face the other end of the second lighting device 100-2 in a straight line. Here, when one or more of the first lighting device 100-1 and the second lighting device 100-2 are pressed toward the other, the first connection device 108 of the first lighting device 100-1 and the second connection device 110 of the second lighting device 100-2 may be coupled to each other so that the first lighting device 100-1 and the second lighting device 100-2 are mechanically and electrically coupled to each other.

A bracket member 114 may be mounted on lower portions of the first and second lighting devices 100-1 and 100-2, and thus, the first and second lighting devices 100-1 and 100-2 may be more firmly coupled to each other. That is, the bracket member 114 may assist the coupling between the first lighting device 100-1 and the second lighting device 100-2, which are firmly coupled to each other through the first connection device 108 of the first lighting device 100-1 and the second connection device 110 of the second lighting device 100-2.

The bracket member 114 may include a first bracket part 114-1 and a second bracket part 114-2.

The first bracket part 114-1 may be provided to be in contact with bottom surfaces of the first and second lighting devices 100-1 and 100-2. In an exemplary embodiment, the first bracket part 114-1 may be provided in the form of a flat plate. The second bracket part 114-2 may be provided to protrude upward from each of both sides of the first bracket part 114-1. The second bracket part 114-2 may be provided to be coupled to each of both sides of lower ends of the first lighting device 100-1 and the second lighting device 100-2.

A bracket coupling part 114-2*a* may be provided on an upper end of the second bracket part 114-2. The bracket coupling part 114-2*a* may be provided to be coupled to each of upper ends of the housing parts 106 of the first lighting device 100-1 and the second lighting device 100-2. Specifically, the bracket coupling part 114-2*a* may be provided to be coupled to the outside of a first hook protrusion 106-1*a* of each of the first lighting device 100-1 and the second lighting device 100-2.

Figure 6:
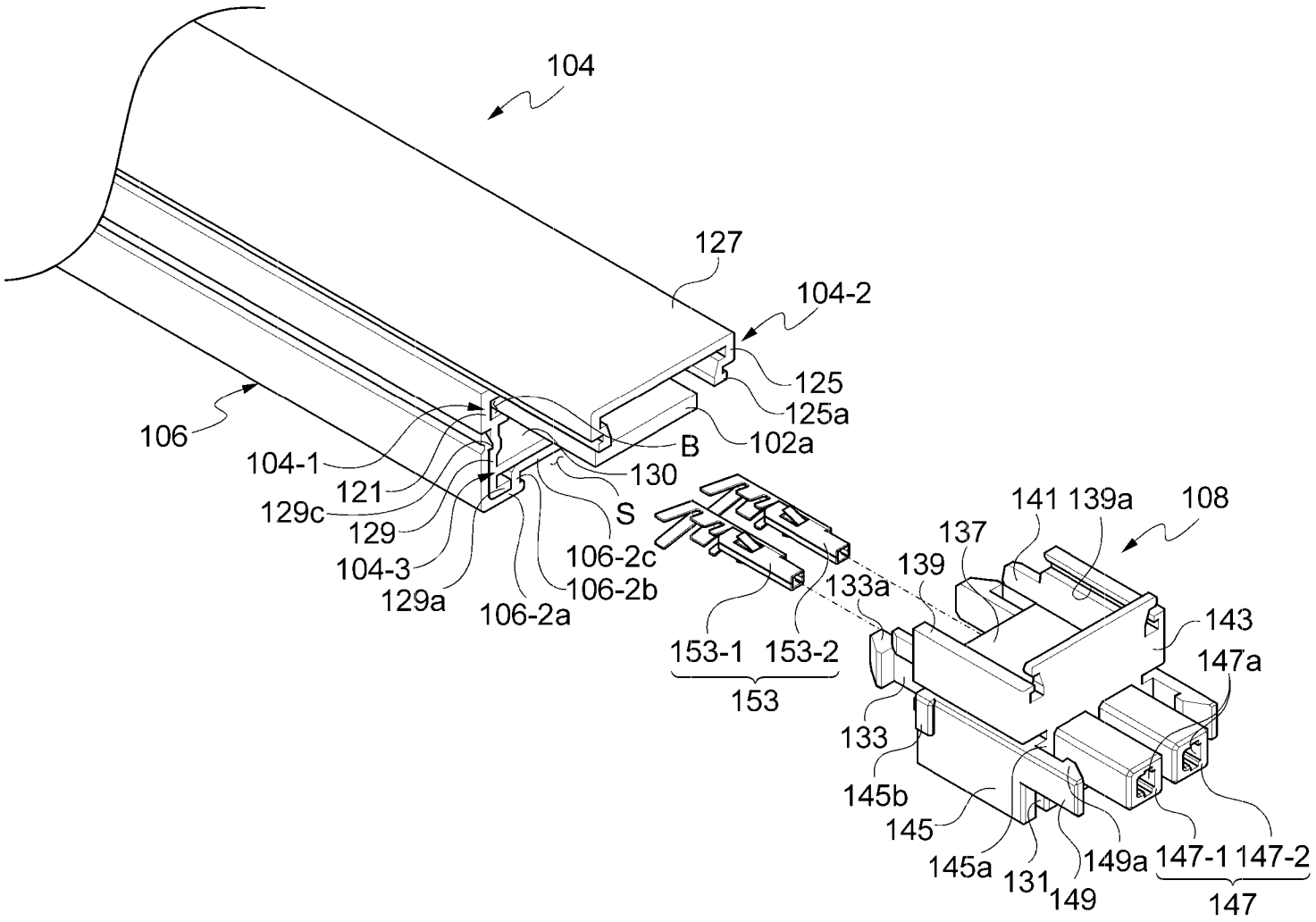
FIG. 6 is a view illustrating a state in which a first connection device is coupled to one end of the lighting part according to an embodiment of the present invention.
Figure 7:
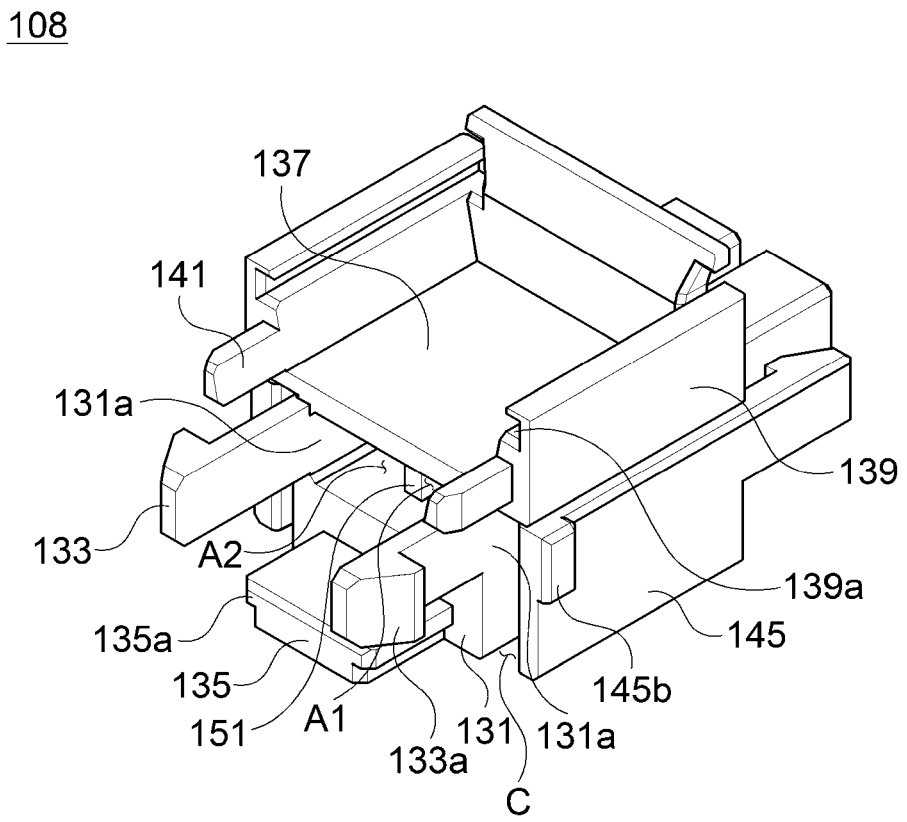
FIG. 7 is a rear perspective view illustrating the first connection device according to an embodiment of the present invention.

FIG. 6 is a view illustrating a state in which a first connection device is coupled to one end of the lighting part according to an embodiment of the present invention, and FIG. 7 is a rear perspective view illustrating the first connection device according to an embodiment of the present invention.

Referring to FIGS. 6 and 7, a first connection device 108 may be coupled to one end of the lighting device 100. The first connection device 108 may include a connection body part 131, a first coupling protrusion 133, a second coupling protrusion 135, a substrate seating part 137, a slide coupling part 139, a third coupling protrusion 141, a finishing frame 143, a side frame 145, a first connection coupling part 147, and a second connection coupling part 149.

The connection body part 131 may have a hexahedral shape, but the shape is not limited thereto. The connection body side part 131*a* may be provided at each of both ends of an upper end of the connection body part 131. The connection body side part 131*a* may be provided to protrude upward from each of both sides of a top surface of the connection body part 131.

The first coupling protrusion 133 may be provided to protrude from a front end of the connection body side part 131*a* toward the diffusing part 104. The first coupling protrusion 133 may be inserted into the third diffusing body 104-3 so as to be coupled to the third diffusing body 104-3. The first coupling protrusion 133 may be inserted into the third side plate 129. A second hook protrusion 133*a* may be provided on an end of the first coupling protrusion 133. The second hook protrusion 133*a* may be provided to be inclined outward from the end of the first coupling protrusion 133.

Figure 8:
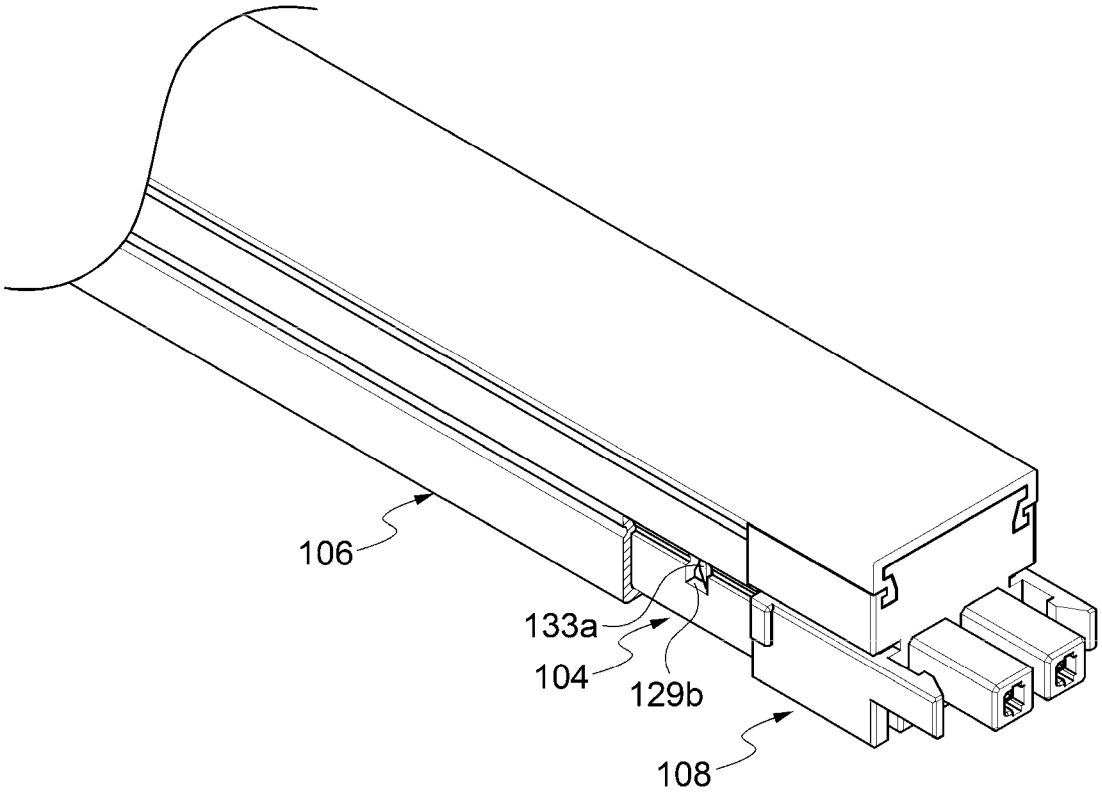
FIG. 8 is a view illustrating a state in which a second hook protrusion is inserted into and hooked with a hook hole when the first connection device is coupled to one end of a diffusing part according to an embodiment of the present invention.

The second hook protrusion 133*a* may be inserted into and hooked with a hook hole 129*b* formed in the third side plate 129. FIG. 8 is a view illustrating a state in which a second hook protrusion 133*a* is inserted into and hooked with the hook hole 129*b* when the first connection device 108 is coupled to one end of the diffusing part 104 according to an embodiment of the present invention. Here, the housing part 106 is partially omitted from the corresponding part for convenience of description.

When the housing part 106 is coupled to the outside of the third diffusing body 104-3, the second hook protrusion 133*a* and the hook hole 129*b* may have an elegant appearance without being exposed to the outside by the housing part 106.

The second coupling protrusion 135 may be provided to protrude from a front surface of the connection body part 131 toward the diffusing part 104. The second coupling protrusion 135 may be coupled to a lower end of the housing part 106. In an exemplary embodiment, the second coupling protrusion 135 may be inserted into the space S formed in the lower portion of the second-3 housing part 106-2*c* so as to be coupled to the housing part 106.

A second seating groove 135*a* may be provided in the second coupling protrusion 135 in a longitudinal direction of the second coupling protrusion 135. When the second coupling protrusion 135 is inserted into the space S formed in the lower portion of the second-3 housing part 106-2*c*, the second seating groove 135*a* may be slidably seated on a top surface of the second-1 housing part 106-2*a*.

The substrate seating part 137 may be provided at an upper portion of the connection body part 131 so as to be spaced apart from the connection body part 131. The substrate seating part 137 may be provided in parallel to the top surface of the connection body part 131. The substrate seating part 137 may be provided in connection with an upper end of the connection body side part 131*a*. A bottom surface of the substrate 102*a* may be seated on the substrate mounting part 137. A partition frame 151 may be provided on a top surface of the connection body part 131 to connect the connection body part 131 to the substrate seating part 137. The partition frame 151 may divide the space between the connection body side parts 131*a* into two sections A1 and A2.

The slide coupling part 139 may be provided to protrude upward from each of both sides of the substrate seating part 137. The slide coupling part 139 may be provided along the longitudinal direction of the substrate seating part 137. The slide coupling part 139 may be slidably coupled to the second diffusing body 104-2. A slide coupling groove 139*a* may be provided along the slide coupling part 139 inside an upper end of the slide coupling part 139. In addition, a slide coupling protrusion 125*a* may be provided at a lower end of the second side plate 125. The slide coupling protrusion 125*a* may be slidably inserted into the slide coupling groove 139*a*.

The third coupling protrusion 141 may be provided to protrude from a front surface of the slide coupling part 139 toward the diffusing part 104. The third coupling protrusion 141 may be inserted into the first diffusing body 104-1 so as to be coupled to the first diffusing body 104-1. Specifically, the third coupling protrusion 141 may be inserted into a space B between the first side plate 121 and the substrate 102*a* and then coupled thereto.

The finishing frame 143 may be provided to protrude upward from a rear end of the substrate seating part 137. An upper end of the finishing frame 143 may be inserted into the second diffusing body 104-2 and then coupled thereto. That is, the upper end of the finishing frame 143 may be provided in a shape corresponding to an inner shape of the second diffusing body 104-2.

Here, since the first connection device 108 is coupled four times to one end of the lighting device 100, firm coupling is possible. That is, the first coupling protrusion 133 may be primarily coupled while being inserted into the third diffusing body 104-3, the second coupling protrusion 135 may be secondarily coupled while being inserted into the lower end of the housing part 106, the slide coupling part 139 may be thirdly coupled while being slidably coupled to the second diffusing body 104-2, and the third coupling protrusion 141 may be fourthly coupled while being inserted into the first diffusing body 104-1. As a result, the first connection device 108 and the lighting device 100 may be firmly coupled to each other to prevent the first connection device 108 from being twisted or bent.

The side frame 145 may be provided to be spaced apart from the connection body part 131 at each of both sides of the connection body part 131. That is, a certain space C may be formed between the connection body part 131 and the side frame 145. In an exemplary embodiment, the side frame 145 may be connected to the connection body side part 131*a* by the side frame connection part 145*a* at a rear end of the connection body side part 131*a*.

A pressing part 145*b* may protrude from an outer surface of the front end of the side frame 145. When a user presses the pressing part 145*b* in a state in which the first connection device 108 is coupled to one end of the lighting device 100, the front end of the side frame 145 is gathered toward the connection body part 131. On the other hand, the second connection coupling part 149 is spread to the outside. Thus, the first connection device 108 of the lighting device 100 may be easily coupled to the second connection device 110 of another lighting device, and the first connection device 108 of the lighting device 100 may be easily detached from the second connection device 110 of another lighting device. A detailed description thereof will be described later with reference to FIG. 11. In addition, since it is easy for the user to check a position of the pressing part 145*b* only by hand feeling, operation convenience is improved.

The first connection coupling part 147 may be provided to protrude from a rear end of the connection body part 131 to the outside (i.e., toward another lighting device). The first connection coupler 147 may be provided in a pair spaced apart from each other. That is, the first connection coupling part 147 may include a first-1 connection coupling part 147-1 and a first-2 connection coupling part 147-2, which are spaced apart from each other.

Connection terminal insertion holes 147*a* may be provided in the first-1 connection coupling part 147-1 and the first-2 connection coupling part 147-2, respectively. A connection terminal part 153 may be inserted into the connection terminal insertion hole 147*a*. The connection terminal part 153 may include a first connection terminal part 153-1 and a second connection terminal part 153-2. The first connection terminal part 153-1 may be inserted into the first section A1 partitioned by the partition frame 151 from a front side of the first connection device 108 and then be inserted into the connection terminal insertion hole 147*a* of the first-1 connection coupling part 147-1 by passing through the first section A1. The second connection terminal part 153-2 may be inserted into the second section A2 partitioned by the partition frame 151 from a front side of the first connection device 108 and then be inserted into the connection terminal insertion hole 147*a* of the first-2 connection coupling part 147-2 by passing through the second section A2.

The connection terminal part 153 may be electrically connected to the substrate 102*a*. The connection terminal part 153 may be electrically connected to the second connection device 110 of another lighting device 100 adjacent to the lighting device 100. In an exemplary embodiment, one end of the connection terminal part 153 may have a hexahedral shape to increase in connection area.

The second connection coupling part 149 may be provided to protrude from a rear end of the side frame 145 to the outside (i.e., toward another lighting device). However, the present invention is not limited thereto, and the second connection coupling part 149 may protrude outward from a rear end of the connection body part 131. A third hook protrusion 149*a* may be provided on an end of the second connection coupling part 149. The third hook protrusion 149*a* may be provided to be inclined inward from an end of the second connection coupling part 149.

Figure 9:
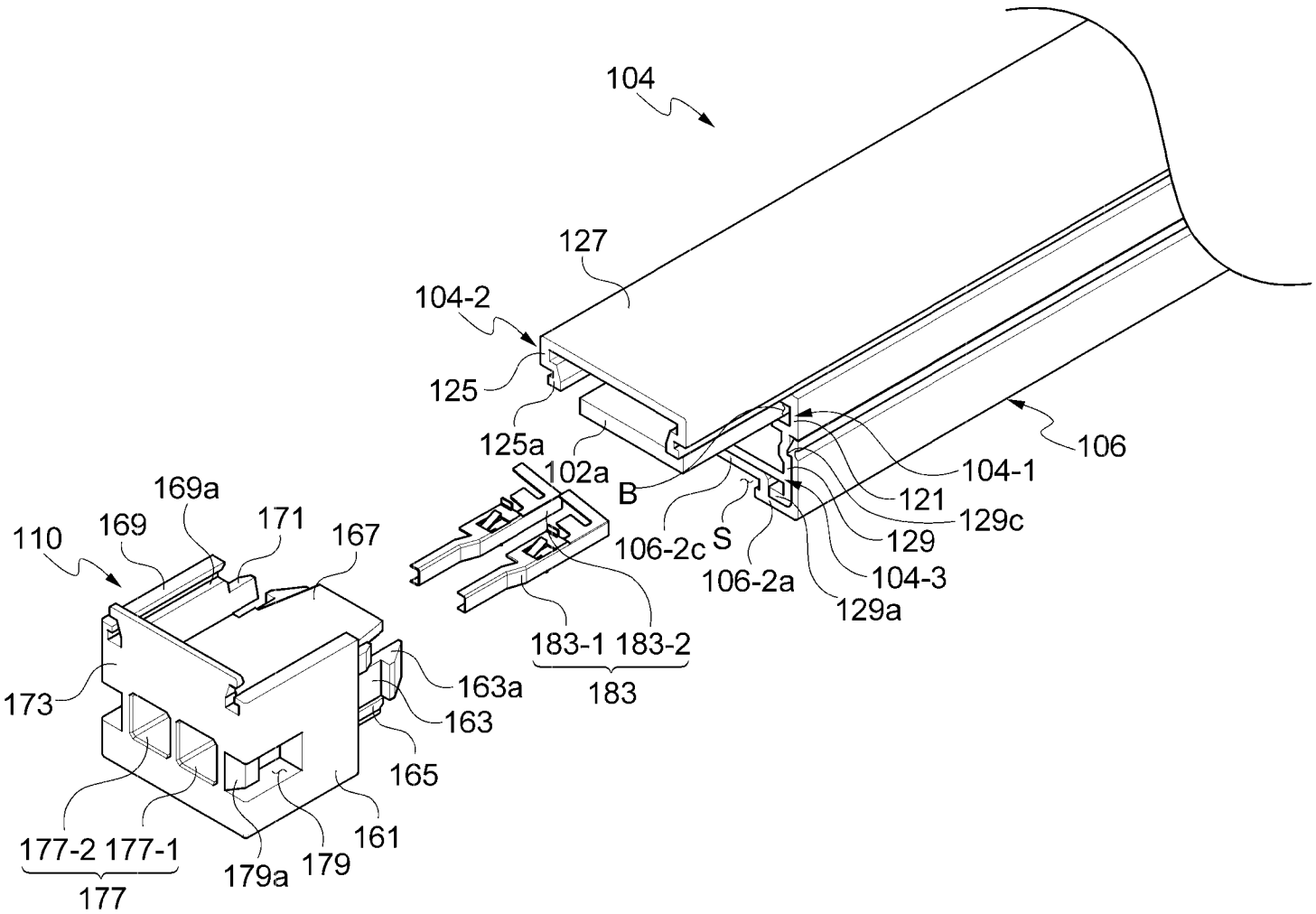
FIG. 9 is a view illustrating a state in which a second connection device is coupled to the other end of the lighting device according to an embodiment of the present invention.
Figure 10:
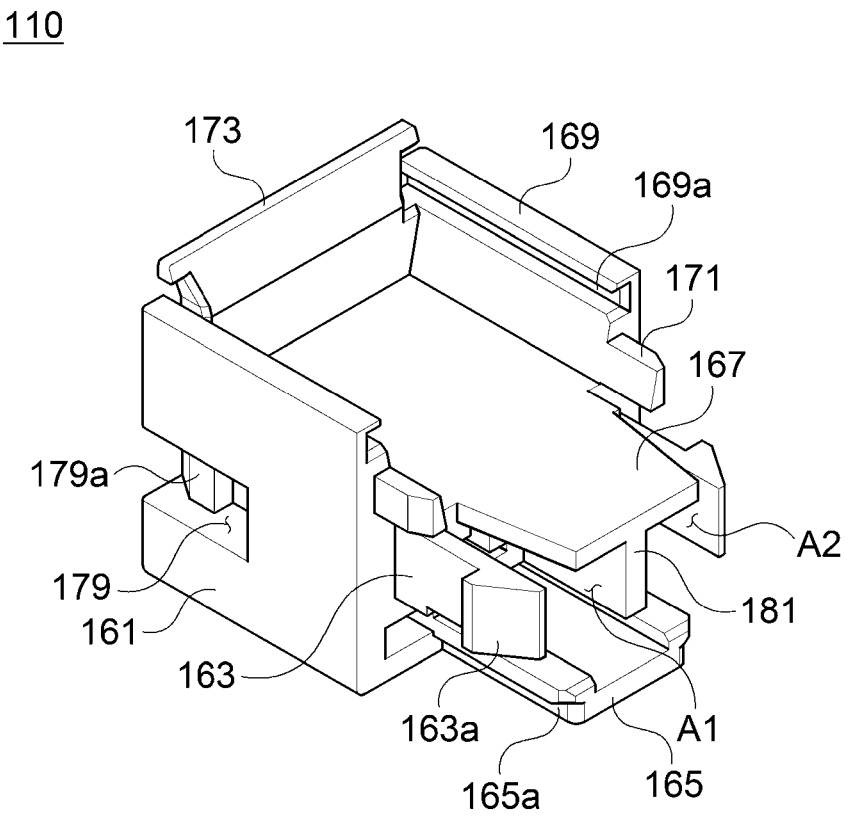
FIG. 10 is a front perspective view illustrating the second connection device according to an embodiment of the present invention.

FIG. 9 is a view illustrating a state in which the second connection device is coupled to the other end of the lighting device according to an embodiment of the present invention, and FIG. 10 is a front perspective view illustrating the second connection device according to an embodiment of the present invention.

Referring to FIGS. 9 and 10, the second connection device 110 may be coupled to the other end of the lighting device 100. The first connection device 110 may include a connection body part 161, a first coupling protrusion 163, a second coupling protrusion 165, a substrate seating part 167, a slide coupling part 169, a third coupling protrusion 171, a finishing frame 173, a first connection coupling part 177, and a second connection coupling part 179.

The connection body part 161 may have a hexahedral shape, but the shape is not limited thereto. In an exemplary embodiment, a side surface of the connection body part 161 may be provided to further extend outward than the connection body part 131 of the first connection device 108.

The first coupling protrusion 163 may be provided to protrude from a front end of the connection body part 161 toward the diffusing part 104. The first coupling protrusion 163 may be inserted into the third diffusing body 104-3 so as to be coupled to the third diffusing body 104-3. The first coupling protrusion 163 may be inserted into the third side plate 129. A second hook protrusion 163*a* may be provided on an end of the first coupling protrusion 163. The second hook protrusion 163*a* may be provided to be inclined outward from the end of the first coupling protrusion 163. The second hook protrusion 163*a* may be inserted into and hooked with a hook hole 129*b* formed in the third side plate 129.

The second coupling protrusion 165 may be provided to protrude from a front surface of the connection body part 161 toward the diffusing part 104. The second coupling protrusion 165 may be coupled to a lower end of the housing part 106. In an exemplary embodiment, the second coupling protrusion 165 may be inserted into the space S formed in the lower portion of the second-3 housing part 106-2*c* so as to be coupled to the housing part 106.

A second seating groove 165*a* may be provided in the second coupling protrusion 165 in a longitudinal direction of the second coupling protrusion 165. When the second coupling protrusion 165 is inserted into the space S formed in the lower portion of the second-3 housing part 106-2*c*, the second seating groove 165*a* may be slidably seated on a top surface of the second-1 housing part 106-2*a*.

The substrate seating part 167 may be provided on the connection body part 161. A front end of the substrate seating part 167 may be provided to protrude from an upper portion of the connection body part 161 toward the diffusing part 104. A partition frame 181 may protrude toward the diffusing part 104 on a front surface of the connection body part 161 to connect the connection body part 161 to the substrate seating part 167. The partition frame 181 may divide a space between the first coupling protrusions 163 into two sections A1 and A2.

The slide coupling part 169 may be provided to protrude upward from each of both sides of the substrate seating part 167. The slide coupling part 169 may be provided along the longitudinal direction of the substrate seating part 167. The slide coupling part 169 may be slidably coupled to the second diffusing body 104-2. A slide coupling groove 169*a* may be provided along the slide coupling part 169 inside an upper end of the slide coupling part 169. Also, the slide coupling protrusion 125*a* of the second side plate 125 may be slidably inserted into the slide coupling groove 169*a*.

The third coupling protrusion 171 may be provided to protrude from a front surface of the slide coupling part 169 toward the diffusing part 104. The third coupling protrusion 171 may be inserted into the first diffusing body 104-1 so as to be coupled to the first diffusing body 104-1. Specifically, the third coupling protrusion 171 may be inserted into a space B between the first side plate 121 and the substrate 102*a* and then coupled thereto.

The finishing frame 173 may be provided to protrude upward from a rear end of the substrate seating part 167. An upper end of the finishing frame 173 may be inserted into the second diffusing body 104-2. That is, the upper end of the finishing frame 173 may be provided in a shape corresponding to an inner shape of the second diffusing body 104-2.

Here, since the second connection device 110 is coupled four times to the other end of the lighting device 100, firm coupling is possible. That is, the first coupling protrusion 163 may be primarily coupled while being inserted into the third diffusing body 104-3, the second coupling protrusion 165 may be secondarily coupled while being inserted into the lower end of the housing part 106, the slide coupling part 169 may be thirdly coupled while being slidably coupled to the second diffusing body 104-2, and the third coupling protrusion 171 may be fourthly coupled while being inserted into the first diffusing body 104-1. As a result, the second connection device 110 and the lighting device 100 may be firmly coupled to each other to prevent the second connection device 110 from being twisted or bent.

The first connection coupling part 177 may be provided in the form of a hole passing through the inside of the connection body part 161 in the connection body part 161. The first connection coupling part 147 of the first connection device 108 of another lighting device 100 may be inserted into and coupled to the first connection coupling part 177 when the lighting device 100 and another lighting device 100 are coupled to each other.

The first connection coupler 177 may be provided in a pair spaced apart from each other. That is, the first connection coupling part 177 may include a first-1 connection coupling part 177-1 and a first-2 connection coupling part 177-2, which are spaced apart from each other. The connection terminal part 183 may be inserted into the first connection coupling part 177.

The connection terminal part 183 may include a first connection terminal part 183-1 and a second connection terminal part 183-2. The first connection terminal part 183-1 may be inserted into the first section A1 partitioned by the partition frame 181 from a front side of the second connection device 110 and then be inserted into the first-1 connection coupling part 177-1 by passing through the first section A1. The second connection terminal part 183-2 may be inserted into the second section A2 partitioned by the partition frame 181 from a front side of the second connection device 110 and then be inserted into the first-2 connection coupling part 177-2 by passing through the second section A2.

The connection terminal part 183 may be electrically connected to the substrate 102*a*. The connection terminal part 183 may be electrically connected to the first connection device 108 of another lighting device 100 adjacent to the lighting device 100. In an exemplary embodiment, one end of the connection terminal part 183 may have a hexahedral shape to increase in connection area.

The second connection coupling part 179 may be provided in the form of a groove at each of both sides of the connection body part 161. When the lighting device 100 is coupled to another lighting device 100, the second connection coupling part 179 of the first connection device 108 may be coupled to the second connection coupling part 179. A hook groove 179*a* through which the third hook protrusion 149*a* of the first connection device 108 is hooked may be provided in the second connection coupling part 179.

According to the disclosed embodiment, the lighting device 100 may be connected to another lighting device through one or more of the first connection device 108 and the second connection device 110. Thus, when being connected to another lighting device, the lighting device 100 and another lighting device may be firmly coupled to each other to prevent a dark zone from occurring.

Figure 11:
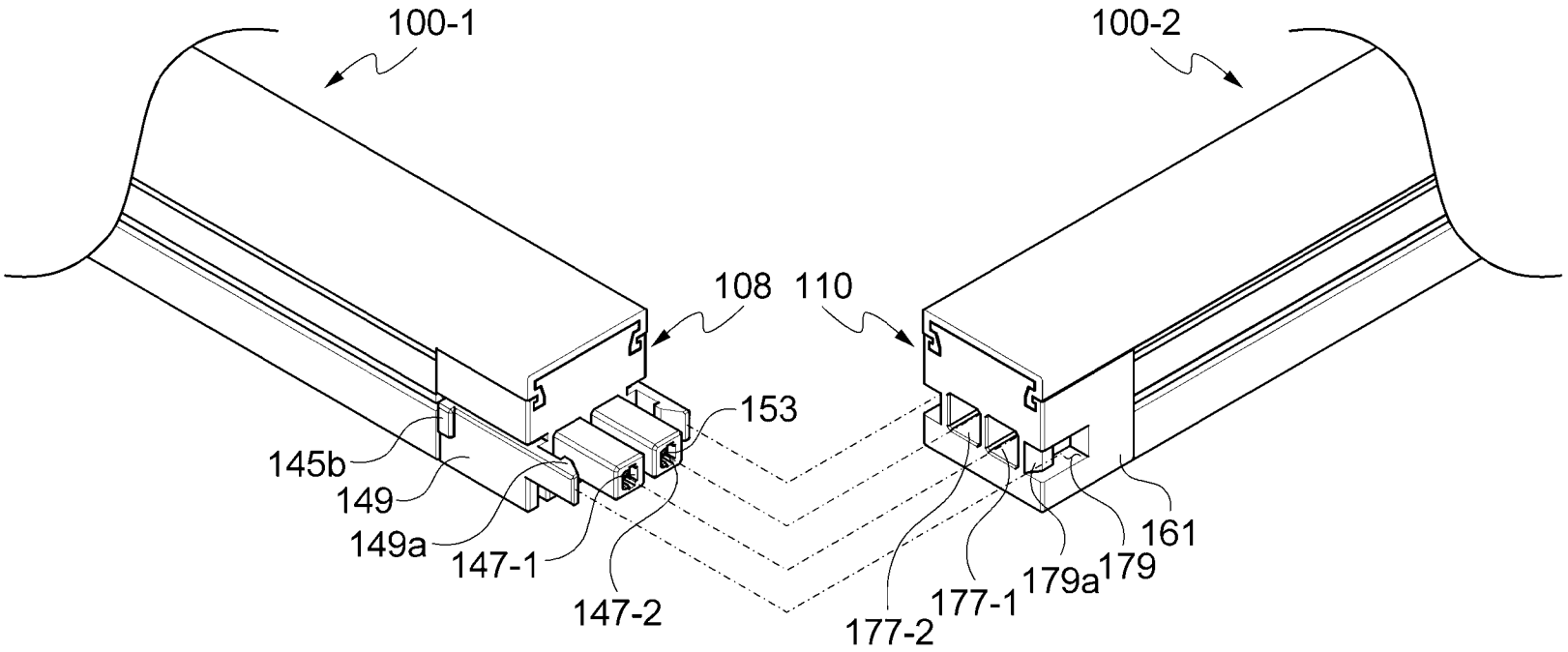
FIG. 11 is a view illustrating a state in which the first connection device of a first lighting device and the second connection device of a second lighting device are coupled to each other according to an embodiment of the present invention.

FIG. 11 is a view illustrating a state in which the first connection device of the first lighting device and the second connection device of the second lighting device are coupled to each other according to an embodiment of the present invention.

Referring to FIG. 11, the first connection device 108 may be coupled to one end of the first lighting device 100-1, and the second connection device 110 may be coupled to one end of the second lighting device 100-2.

Here, the first-1 connection coupling part 147-1 and the first-2 connection coupling part 147-2 of the first lighting device 100-1 may be inserted into and coupled to the first-1 connection coupling part 177-1 and the first-2 connection coupling part 177-2 of the second lighting device 100-2, respectively. Here, the connection terminal part 153 of the first lighting device 100-1 and the connection terminal part 183 of the second lighting device 100-2 are electrically connected to each other.

In addition, the second connection coupling part 149 of the first lighting device 100-1 may be coupled to the second connection coupling part 179 of the second lighting device 100-2. Here, the third hook protrusion 149*a* of the first lighting device 100-1 may be hooked in the hook groove 179*a* of the second lighting device 100-2.

Specifically, when the pressing part 145*b* of the first lighting device 100-1 is pressed, the second connection coupling part 149 of the first lighting device 100-1 may be spread outward so that the third hook protrusion 149*a* of the first lighting device 100-1 is disposed at a position corresponding to the hook groove 178*a* of the second lighting device 100-2. Also, when the pushing of the pressing part 145*b* of the first lighting device 100-1 is released, the third hook protrusion 149*a* of the first lighting device 100-1 is easily hooked and coupled to the hook groove 179*a* of the second lighting device 100-2.

Also, when the first connection device 108 of the first lighting device 100-1 is detached from the second connection device 110 of the second lighting device 100-2, if the pressing part 145*b* of the first lighting device 100-1 is pressed, the second connection coupling part 149 of the first lighting device 100-1 may be spread outward so that the third hook protrusion 149*a* of the first lighting device 100-1 is separated from the hook groove 179*a* of the second lighting device 100-2. Thus, the first connection device 108 of the first lighting device 100-1 may be easily detached from the second connection device 110 of the second lighting device 100-2.

Figure 12:
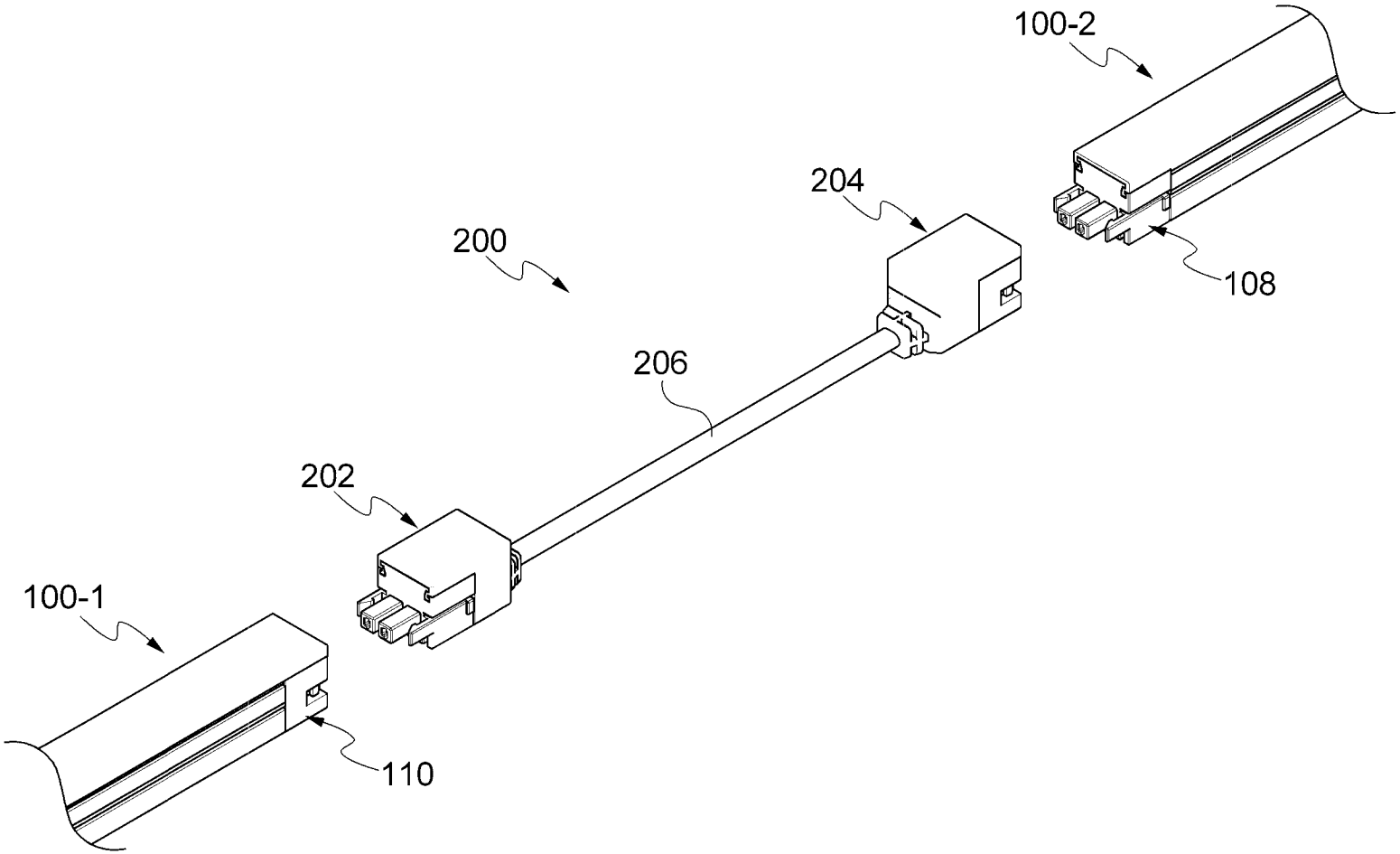
FIG. 12 is a view illustrating a state in which a first lighting device and a second lighting device are coupled to each other according to another embodiment of the present invention.

FIG. 12 is a view illustrating a state in which a first lighting device and a second lighting device are coupled to each other according to another embodiment of the present invention.

Referring to FIG. 12, a connection device 200 may be provided between a first lighting device 100-1 and a second lighting device 100-2. The connection device 200 may include a first connection device 202, a second connection device 204, and a connection part 206. The first connection device 202 may have the same or similar configuration to the first connection device 108 illustrated in FIGS. 6 and 7. The second connection device 204 may have the same or similar configuration to the second connection device 110 illustrated in FIGS. 9 and 10. Thus, detailed descriptions of the configuration of the first connection device 202 and the second connection device 204 will be omitted below.

The connection part 206 may mechanically and electrically connect the first connection device 202 to the second connection device 204 between the first connection device 202 and the second connection device 204. Here, although the connection part 206 is illustrated as connecting the first connection device 202 to the second connection device 204 in a straight line, but the present invention is not limited thereto, and the connection part 206 may be provided in a flexible manner. In this case, the first connection device 202 and the second connection device 204 may be connected to each other while the connection part 206 is bent according to positions of the first connection device 202 and the second connection device 204.

The first connection device 202 may be coupled to the second connection device 110 of the first lighting device 100-1. The second connection device 204 may be coupled to the first connection device 108 of the second lighting device 100-2. Here, the first lighting device 100-1 and the second lighting device 100-2 spaced apart from each other according to a length of the connection part 206 may be mechanically and electrically connected to each other.

Figure 13:
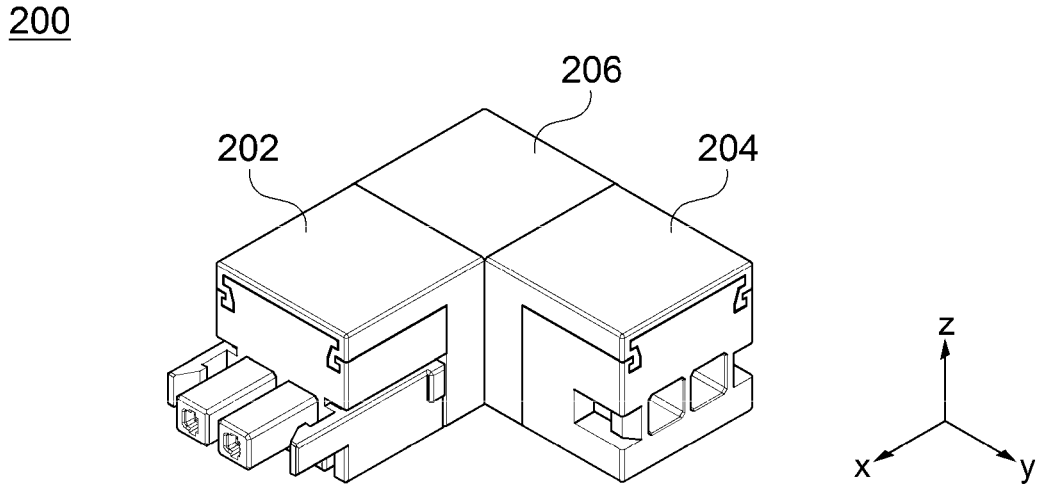
FIGS. 13 to 15 are views illustrating a connection device for connecting two or more lighting devices to each other according to an embodiment of the present invention.
Figure 14:
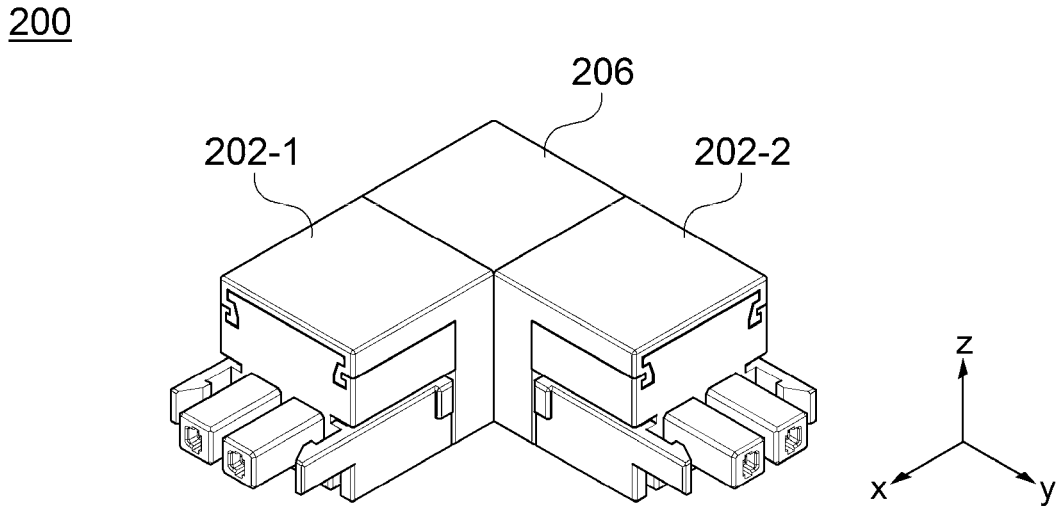
Figure 15:
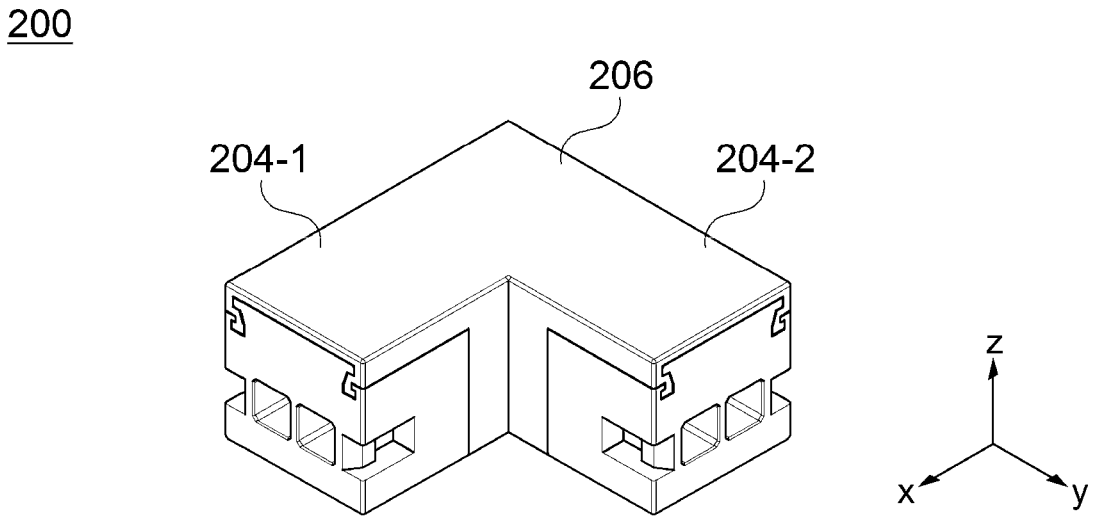

FIGS. 13 to 15 are views illustrating the connection device for connecting two or more lighting devices to each other according to an embodiment of the present invention.

Referring to FIG. 13, the connection device 200 may include a first connection device 202, a second connection device 204, and a connection part 206. In an exemplary embodiment, the connection part 206 may vertically connect the first connection device 202 to the second connection device 204. However, the present invention is not limited thereto, and the connection part 206 may connect the first connection device 202 to the second connection device 204 at various angles (e.g., 60 degrees or 120 degrees).

Referring to FIG. 14, the connection device 200 may include a first-1 connection device 202-1, a first-2 connection device 202-2, and a connection part 206. In an exemplary embodiment, the connection part 206 may vertically connect the first-1 connection device 202-1 to the first-2 connection device 202-2. However, the present invention is not limited thereto, and the connection part 206 may connect the first-1 connection device 202-1 to the first-2 connection device 202-2 at various angles (e.g., 60 degrees or 120 degrees).

Referring to FIG. 15, the connection device 200 may include a second-1 connection device 204-1, a second-2 connection device 204-2, and a connection part 206. In an exemplary embodiment, the connection part 206 may vertically connect the second-1 connection device 204-1 to the second-second connection device 204-2. However, the present invention is not limited thereto, and the connection part 206 may connect the second-1 connection device 204-1 to the second-2 connection device 204-2 at various angles (e.g., 60 degrees or 120 degrees). In an exemplary embodiment, the second-1 connection device 204-1, the second-2 connection device 204-2, and the connection part 206 may be provided to be integrated with each other.

Although the connection part 206 is illustrated as connecting the two connection devices to each other, the present invention is not limited thereto, and several connection devices may be connected to each other. For example, three connection devices may be connected at an interval of 90 degrees or 120 degrees, and four connection devices may be connected at an interval of 90 degrees. In addition, here, although the connection part 206 connects the connection devices to each other on two axes (for example, in FIG. 13, an x-axis that is a longitudinal direction of the first lighting device 202 and a y-axis that is a longitudinal direction of the second lighting device 204), the present invention is not limited thereto, and the connection devices may be connected on several axes, for example, three axes (x-axis, y-axis, and z-axis).

In addition, the connection device 200 may be provided with an auxiliary substrate having one or more auxiliary lighting unit. In this case, it is possible to prevent a dark zone from occurring when several lighting devices are connected to each other through the connection device 200. For example, the auxiliary substrate may be provided in the connection part 206 and the connection device.

Although the present invention has been described in detail through exemplary embodiments above, those of ordinary skill in the art to which the present invention pertains will understand that various modifications can be made to the above-described embodiments without departing from the scope of the present invention. Therefore, the scope of this disclosure is defined not by the detailed description of the invention but by the appended claims, and all differences within the scope will be construed as being included in the present invention.

What is claimed is:

1. A lighting device comprising:

a lighting part comprising a substrate provided along a longitudinal direction of the lighting device and a lighting unit provided on the substrate;

a diffusing part provided along the longitudinal direction of the lighting device, configured to accommodate the lighting part therein, configured to diffuse light generated in the lighting part, and provided with a hook hole in a side surface thereof;

a connection device mechanically and electrically coupled to an end of the lighting device; and a housing part, wherein the connection device comprises:

a connection body part comprising a connection body side part protruding upward from each of both sides of a top surface thereof; and a first coupling protrusion which is provided to protrude from a front end of the connection body side part to the diffusing part and inserted into the diffusing body to be coupled to the diffusing body and which comprises a second hook protrusion protruding outward from the end of the first coupling protrusion and inserted into and hooked with the hook hole, wherein the housing part is coupled to the outside of the diffusing body and configured to cover the hook hole having the second hook protrusion inserted thereinto.

2. The lighting device of claim 1, wherein the diffusing part comprises a first diffusing body configured to accommodate the lighting part therein, wherein the first diffusing body comprises:

a first side plate provided on each of both side surfaces of the first diffusion body; and a substrate accommodation part protruding from an inner surface of the first side plate to the inside of the diffusing part to form a space in which the lighting part is accommodated.

3. The lighting device of claim 2, wherein the substrate accommodation part comprises:

a first substrate accommodation part protruding from a lower end of the inner surface of the first side plate to the inside of the diffusing part; and a second substrate accommodation part protruding from an upper end of the inner surface of the first side plate to the inside of the diffusing part, wherein the lighting part is slid and accommodated into a space between the first substrate accommodation part and the second substrate accommodation part.

4. The lighting device of claim 3, wherein the substrate has a width greater than each of an interval between the first substrate accommodation parts and an interval between the second substrate accommodation parts.

5. The lighting device of claim 2, wherein the diffusing part further comprises:

a second diffusing body provided above the first diffusing body; and a third diffusing body provided below the first diffusing body.

6. The lighting device of claim 5, wherein the second diffusing body has both ends, which further protrude in a longitudinal direction of the diffusing part than both ends of the first diffusing body, respectively, and the third diffusing body is provided to have a length corresponding to a length of the first diffusing body.

7. The lighting device of claim 5, wherein the second diffusing body comprises:

a second side plate connected to the first diffusion body at an upper end of the first diffusing body and provided on each of both side surfaces of the second diffusing body; and a second connection plate provided to connect the second side plate at an upper end of the second side plate.

8. The lighting device of claim 5, wherein the third diffusing body comprises:

a third side plate connected to the first diffusing body at a lower end of the first diffusing body and provided on each of both side surfaces of the third diffusing body; and a second connection plate provided to connect the third side plates to each other between the third side plates, wherein the third side plate comprises a first seating groove provided along a longitudinal direction of the third side plate on an outer surface of the third side plate.

9. The lighting device of claim 8, wherein the housing part comprises:

a first housing part provided on an outer surface of the third side plate and comprising a first hook protrusion seated in the first seating groove at an upper end of the first housing part so as to be coupled to the third diffusing body; and a second housing part provided to connect a lower end of the first housing part.

10. The lighting device of claim 9, wherein the third side plate further comprises a bent part bent from a lower end of the third side plate to the inside of the diffusing part, wherein the second housing part comprises:

a second-1 housing part connected inward from each of lower ends of both side;

a second-2 housing part protruding upward from a top surface of the second-1 housing part; and a second-3 housing part provided to connect upper ends of the second-2 housing parts to each other, wherein the bent part is inserted between the first housing part and the second-2 housing part and seated on a top surface of the second-1 housing part.

11. The lighting device of claim 1, wherein the diffusing part comprises:

a first diffusing body configured to accommodate the lighting part therein;

a second diffusing body provided above the first diffusing body; and a third diffusing body provided below the first diffusing body.

12. The lighting device of claim 11, wherein the third diffusing body has a width less than a width of the first diffusing body.

13. The lighting device of claim 11, wherein the connection device further comprise a substrate seating part which is provided on an upper portion of the connection body part and on which the substrate is seated.

14. The lighting device of claim 13, wherein the connection device further comprises:

a side frame provided to be spaced apart from the connection body part on both side surfaces of the connection body part; and a side frame connection part configured to connect the connection body side part to the side frame, wherein the side frame comprises a pressing part provided to protrude on an outer surface of a front end thereof.

15. The lighting device of claim 13, wherein the second diffusing body comprises a slide coupling protrusion of which both ends are provided to further protrude in a longitudinal direction of the diffusing part than both ends of the first diffusing body and which is provided along a longitudinal direction of the second diffusing body at a lower end of the protruding second diffusing body, and the connection device further comprises a slide coupling part provided to protrude upward from both sides of the substrate seating part and provided with a slide coupling groove so that the slide coupling protrusion is slidably inserted into an upper end thereof.

16. The lighting device of claim 15, wherein the connection part further comprises a second coupling protrusion provided to protrude from a front surface of the connection body part to the diffusing part and inserted into a space formed in a lower portion of the housing part so as to be coupled to the housing part.

17. The lighting device of claim 16, wherein the connection part further comprises:

a third coupling protrusion provided to protrude from a front surface of the slide coupling part to the diffusion part and inserted into the first diffusing body so as to be coupled to the first diffusing body; and a finishing frame which is provided to protrude upward from a rear end of the substrate seating part and of which an upper end is inserted into and coupled to the second diffusing body.

18. The lighting device of claim 13, wherein the connection device further comprises:

a first connection coupling part provided to protrude outward from a rear end of the connection body part, coupled to a connection device of another lighting device adjacent to the lighting device, and comprising a connection terminal insertion hole into which the connection terminal part is inserted; and a second connection coupling part provided to protrude outward from the rear end of the connection body part and coupled to the connection device of another lighting device.

* * * * *